US008157002B2

(12) United States Patent
Clarkson et al.

(10) Patent No.: US 8,157,002 B2
(45) Date of Patent: Apr. 17, 2012

(54) SLIP RING APPARATUS FOR A ROTARY STEERABLE TOOL

(75) Inventors: Mark J. Clarkson, Houston, TX (US); Pralay Das, Sugar Land, TX (US); Al Jerabek, Houston, TX (US); Hector R. Guzman, Spring, TX (US)

(73) Assignee: Smith International Inc., Houston, TX (US)

( * ) Notice: Subject to any disclaimer, the term of this patent is extended or adjusted under 35 U.S.C. 154(b) by 470 days.

(21) Appl. No.: 12/506,785

(22) Filed: Jul. 21, 2009

(65) Prior Publication Data

US 2011/0017473 A1 Jan. 27, 2011

(51) Int. Cl.
*E21B 17/02* (2006.01)
*E21B 47/16* (2006.01)
*E21B 7/06* (2006.01)

(52) U.S. Cl. ..... 166/65.1; 166/380; 175/73; 175/320

(58) Field of Classification Search ..... 166/380, 166/65.1; 175/73, 320
See application file for complete search history.

(56) References Cited

U.S. PATENT DOCUMENTS 4,043,621 A 8/1977 Heinz
4,271,336 A 6/1981 Shitrai
4,544,215 A 10/1985 Fritsch
4,598,185 A 7/1986 Moore
5,294,923 A 3/1994 Juergens et al.
5,651,687 A 7/1997 Du-Rocher et al.
5,952,762 A 9/1999 Larsen et al.
7,320,363 B2 1/2008 Sand et al.
2005/0230098 A1 10/2005 Sand et al.

OTHER PUBLICATIONS

International Search Report and Written Opinion dated Feb. 23, 2011 for corresponding PCT application No. PCT/US2010/042581 filed Jul. 20, 2010.

*Primary Examiner* — Giovanna Wright

(74) *Attorney, Agent, or Firm* — Darla Fonseca; Bridgitte Echols; Charlotte Rutherford

(57) ABSTRACT

A downhole tool includes a slip ring assembly deployed radially between a shaft and a housing. The slip ring assembly may be configured as a stand-alone assembly and is further configured to provide a plurality of distinct electrical communication channels between the shaft and housing. These communication channels are suitable for transmitting electrical power and/or electronic data. Electrical connection is made between the housing and the slip ring assembly via a connector block that is fastened to a plurality of stator rings in the slip ring assembly. The connector block extends radially outward from the stator rings and physically engages an opening in the housing thereby rotationally coupling the stator rings to the housing.

21 Claims, 8 Drawing Sheets

SLIP RING APPARATUS FOR A ROTARY STEERABLE TOOL

RELATED APPLICATIONS

None.

FIELD OF THE INVENTION

The present invention relates generally to downhole tools having rotating components, for example, including directional drilling tools such as a steering tool or a mud motor. More particularly, exemplary embodiments of this invention relate to a rotary steerable tool including a slip ring assembly for transmitting electrical power and/or data between a shaft and housing.

BACKGROUND OF THE INVENTION

As is well-known in the industry, hydrocarbons are recovered from subterranean reservoirs by drilling a borehole (wellbore) into the reservoir. Such boreholes are commonly drilled using a rotating drill bit attached to the bottom of a drilling assembly (which is commonly referred to in the art as a bottom hole assembly or a BHA). The drilling assembly is commonly connected to the lower end of a drill string including a long string of sections (joints) of drill pipe that are connected end-to-end via threaded pipe connections. The drill bit, deployed at the lower end of the BHA, is commonly rotated by rotating the drill string from the surface and/or by a mud motor deployed in the BHA. Mud motors are also commonly utilized with flexible, spoolable tubing referred to in the art as coiled tubing. During drilling a drilling fluid (referred to in the art as mud) is pumped downward through the drill string (or coiled tubing) to provide lubrication and cooling of the drill bit. The drilling fluid exits the drilling assembly through ports located in the drill bit and travels upward, carrying debris and cuttings, through the annular region between the drilling assembly and borehole wall.

In recent years, directional control of the borehole has become increasingly important in the drilling of subterranean oil and gas wells, with a significant proportion of current drilling activity involving the drilling of deviated boreholes. Such deviated boreholes often have complex profiles, including multiple doglegs and a horizontal section that may be guided through thin, fault bearing strata, and are typically utilized to more fully exploit hydrocarbon reservoirs. Deviated boreholes are often drilled using downhole steering tools, such as two-dimensional and three-dimensional rotary steerable tools. Certain rotary steerable tools include a plurality of independently operable blades (or force application members) that are disposed to extend radially outward from a tool housing into contact with the borehole wall. The direction of drilling may be controlled, for example, by controlling the magnitude and direction of the force or the magnitude and direction of the displacement applied to the borehole wall. In such rotary steerable tools, the blade housing is typically deployed about a rotatable shaft, which is coupled to the drill string and disposed to transfer weight and torque from the surface (or from a mud motor) through the steering tool to the drill bit assembly. Other rotary steerable tools are known that utilize an internal steering mechanism and therefore don't require blades (e.g., the Schlumberger PowerDrive rotary steerable tools).

Directional wells are also commonly drilled by causing a mud motor power section to rotate the drill bit through a displaced axis while the drill string remains stationary (non-rotating). The displaced axis may be achieved, for example, via a bent sub deployed above the mud motor or alternatively via a mud motor having a bent outer housing. The bent sub or bent motor housing cause the direction of drilling to deviate (turn), resulting in a well section having a predetermined curvature (dogleg severity) in the direction of the bend. A drive shaft assembly deployed below the power section transmits downward force and power (rotary torque) from the drill string and power section through a bearing assembly to the drill bit. Common drive shaft assemblies include a coaxial shaft (mandrel) deployed to rotate in a housing.

The non-rotating sections (e.g., the above described housings) commonly include MWD and/or LWD sensors, electronic components and controllers, and electrical actuators (e.g., solenoid actuated valves and switches used to control steering blades). In the above described drilling assemblies a gap typically exists between the rotating and non-rotating sections (e.g., between the shaft and housing). Thus electrical power must be stored and/or generated in the non-rotating section or transferred across the gap from the rotating section to the non-rotating section. Moreover, in order to provide electronic communication between the rotating and non-rotating sections, data must also be transferred back and forth across the gap.

Slip ring assemblies are commonly utilized to transmit electrical power and electronic data across the gap between rotating and non-rotating tool sections. While slip ring assemblies have been used commercially, they can be problematic. For example, slip ring assemblies typically include a number of small components that must be precisely aligned and can therefore be difficult to assemble in the limited physical space between a shaft and sleeve. This difficulty is particularly evident in small diameter (slim) tool embodiments.

Slip rings have also been known to fail in service. Such failures are costly in that they commonly result in a loss of communication with the tool and the need to trip out of the borehole. For example, the failure of slip ring seals can cause a tool failure. Loss of electrical contact between the slip ring contact members (e.g., due to wear) is also a known cause of tool failure. The electrical performance of slip rings is also susceptible to both long term and short term degradation when exposed to oil. Furthermore, when used with heavier grade lubricating oils, liftoff of the contacts may occur. Interruption of the electrical current can then cause burning of the oil and contamination to the contacts.

Owing to the demand for smaller diameter and less expensive rotary steerable tools (and downhole tools in general) and to the increased demand for electrical power in such tools, there is a need for improved slip ring assemblies.

SUMMARY OF THE INVENTION

The present invention addresses the need for improved electrical power and data transmission devices in downhole tools including rotary steerable tools. Aspects of the invention include a slip ring assembly deployed radially between a shaft and a housing in a downhole tool. The slip ring assembly is configured to provide a plurality of distinct electrical communication channels between the shaft and housing. These communication channels are suitable for transmitting electrical power and/or electronic data. Electrical connection is made between the housing and the slip ring assembly via a connector block that is fastened to a plurality of stator rings in the slip ring assembly. The connector block extends radially outward from the stator rings and physically engages an opening in the housing thereby rotationally coupling the stator rings to the housing.

Exemplary embodiments of the present invention may advantageously provide several technical advantages. For example, the slip ring assembly is advantageously configured as a stand-alone assembly. This feature of the invention advantageously simplifies fabrication in that the slip ring assembly may be fully assembled apart from the tool. The fully assembled slip ring may then be deployed on (and connected to) the shaft. This feature of the invention also tends to improve repeatability of the fabrication procedure and therefore the reliability of the fully assembled slip ring in service. Moreover, this feature of the invention also tends to improve the serviceability of the tool in that the slip ring assembly may be easily removed and replaced (or repaired) between drilling operations.

In one aspect the present invention includes a downhole tool. The downhole tool includes a shaft deployed in a housing and configured to rotate with respect to the housing. The housing includes a removable hatch cover deployed over an opening in the housing. A slip ring assembly is deployed about the shaft and is configured to provide electrical connection between the shaft and the housing. The slip ring assembly includes a plurality of axially spaced inner rotor rings deployed substantially concentrically with a corresponding plurality of axially spaced stator rings and a plurality of electrically conductive brushes deployed between the corresponding rotor and stator rings. The rotor rings are configured to rotate with the shaft. A connector block is fastened to the stator rings and extends radially outward from the stator rings and engages the opening in the housing thereby rotationally coupling the stator rings to the housing.

In another aspect the present invention includes a rotary steerable tool. The rotary steerable tool includes a shaft deployed concentrically in a blade housing and configured to rotate about a longitudinal axis with respect to the housing. The housing includes a removable hatch cover deployed over an opening therein. A slip ring assembly is deployed about the shaft and is configured to provide electrical connection between the shaft and the housing. The slip ring assembly includes a substantially cylindrical slip ring carrier, first and second radial bearings deployed about the slip ring carrier, a plurality of axially spaced inner rotor rings deployed substantially concentrically with a corresponding plurality of axially spaced stator rings, the rotor rings and the corresponding stator rings being deployed axially between the bearings, an electrically insulative ring deployed between each of the rotor rings and each of the stator rings, and a plurality of electrically conductive brushes deployed between the corresponding rotor and stator rings. The rotor rings are configured to rotate with the shaft. A connector block is fastened to the stator rings and extends radially outward from the stator rings and engages the opening in the housing thereby rotationally coupling the stator rings to the housing.

In yet another aspect, the present invention includes a method for establishing an electrical connection between first and second electrical devices in a downhole tool in which the first device is rotationally coupled with a shaft, the second device is rotationally coupled with a housing and the shaft is configured to rotate in the housing. The method includes assembling a slip ring assembly that includes a substantially cylindrical slip ring carrier, first and second radial bearings deployed about the slip ring carrier, a plurality of axially spaced inner rotor rings deployed substantially concentrically with a corresponding plurality of axially spaced stator ring, the rotor ring and the corresponding stator rings being deployed axially between the bearings, an electrically insulative ring deployed between each of the rotor rings and each of the stator rings, and a plurality of electrically conductive brushes deployed between the corresponding rotor and stator rings. The slip ring assembly is deployed about the shaft, the deployment rotationally coupling the slip ring carrier to the shaft. The first device is electrically connected with the rotor rings. The housing is deployed about the shaft and the slip ring assembly and a connector block is fastened to the stator rings, the connector block physically engaging an opening in the housing such that the stator rings are rotationally coupled with the housing. The second device is electrically connected with the connector block and the hatch cover is deployed over the opening.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
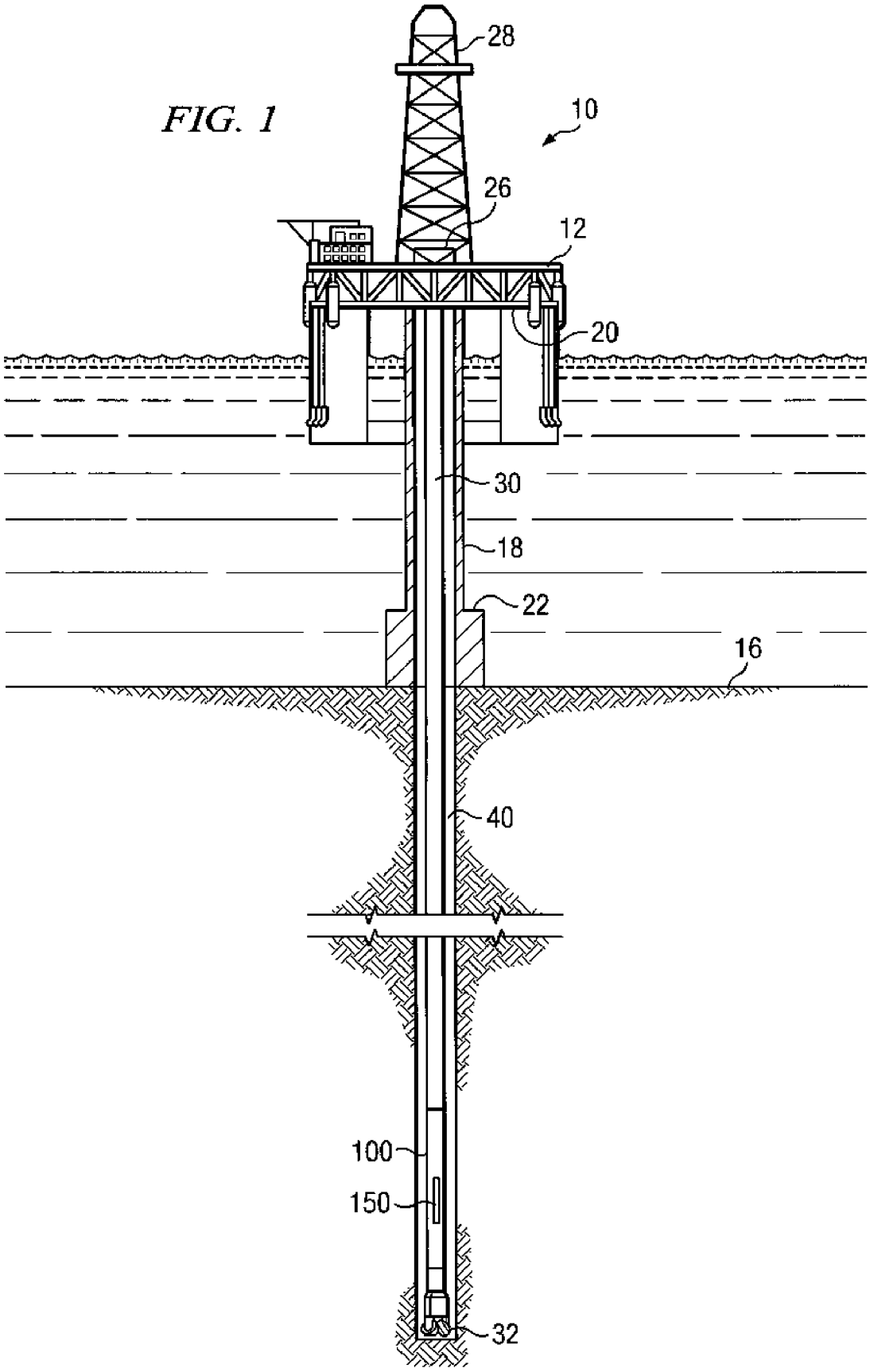
FIG. 1 depicts a drilling rig on which exemplary embodiments of the present invention may be deployed.

Referring first to FIGS. 1 through 8, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 8 may be described herein with respect to that reference numeral shown on other views.

FIG. 1 illustrates a drilling rig 10 suitable for the deployment of exemplary embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a steering tool 100 (such as a three-dimensional rotary steerable tool). In the exemplary embodiment shown, steering tool 100 includes a plurality of blades 150 (e.g., three) disposed to extend outward from the tool 100. The extension of the blades 150 into contact with the borehole wall is intended to eccenter the tool in the borehole, thereby changing an angle of approach of the drill bit 32 (which changes the direction of drilling). Exemplary embodiments of steering tool 100 further include hydraulic 130 and electronic 140 control modules (FIG. 2) configured to control extension and retraction of the blades 150. It will be appreciated that these control modules 130 and 140 typically include various electrical power consuming devices, such as, but not limited to, solenoid controllable valves, sensors (e.g., including accelerometers, pressure transducers, temperature sensors, rotation rate sensors, and the like), and other electronic components (e.g., including microprocessors, electronic memory, timers, and the like). The drill string 30 may also include various electronic devices, e.g., including a telemetry system, additional sensors for sensing downhole characteristics of the borehole and the surrounding formation, and microcontrollers disposed to be in electronic communication with electronic control module 140. The invention is not limited in regards to specific types or makes of electrical and/or electronic devices.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore. While exemplary embodiments of this invention are described below with respect to rotary steerable embodiments, it will be appreciated that the invention is not limited in this regard. For example, as described in more detail below, embodiments of the invention may also be utilized with mud motors (e.g., deployed below the power section) or any other downhole tool deployments in which it is desirable to transfer electrical power and/or electronic data between first and second components that rotate relative to one another.

Figure 2:
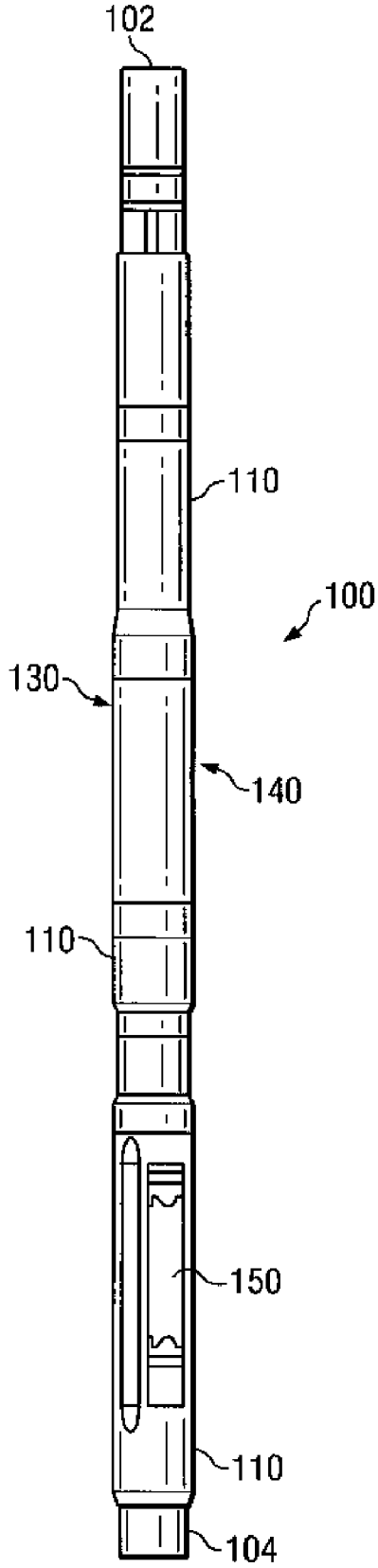
FIG. 2 is a perspective view of one exemplary embodiment of the steering tool shown on FIG. 1.

Turning now to FIG. 2, one exemplary embodiment of steering tool 100 from FIG. 1 is illustrated in perspective view. In the exemplary embodiment shown, steering tool 100 is substantially cylindrical and includes threaded ends 102 and 104 (threads not shown) for connecting with other bottom hole assembly (BHA) components (e.g., connecting with the drill bit at end 104 and upper BHA components at end 102). The steering tool 100 further includes a housing 110 and at least one blade 150 deployed, for example, in a recess (not shown) in the housing 110. Control modules 130 and 140 are deployed in the housing 110. In general, the control modules 130 and 140 are configured for measuring and controlling the direction of drilling. Control modules 130 and 140 may include substantially any devices known to those of skill in the art, such as those disclosed in U.S. Pat. No. 5,603,386 to Webster, U.S. Pat. No. 6,427,783 to Krueger et al, or commonly assigned U.S. Pat. No. 7,464,770 to Jones et al.

To steer (i.e., change the direction of drilling), one or more of blades 150 may be extended into contact with the borehole wall. The steering tool 100 may be moved away from the center of the borehole by this operation, thereby altering the drilling path. It will be appreciated that the tool 100 may also be moved hack towards the borehole axis if it is already eccentered. To facilitate controlled steering, the rotation rate of the housing is desirably less than about 0.1 rpm during drilling, although the invention is not limited in this regard. By keeping the blades 150 in a substantially fixed position with respect to the circumference of the borehole (i.e., by essentially preventing rotation of the housing 110), it is possible to steer the tool without cyclically extending and retracting the blades 150. Non-rotary steerable embodiments are thus typically only utilized in sliding mode (although they may be rotated when steering is not desired). In rotary steerable embodiments, the tool 100 is constructed so that the housing 110, which houses the blades 150, remains stationary, or substantially stationary, with respect to the borehole during directional drilling operations. The housing 110 is therefore constructed in a rotationally non-fixed (or floating) fashion with respect to a shaft 115 (FIG. 3). The shaft 115 is connected with the drill string and is disposed to transfer both torque (rotary power) and weight to the bit.

The above-described control and manipulation of the blades 150 is known to consume electrical power. For example, in one commercially serviceable embodiment, the blades 150 are extended via hydraulic actuation with solenoid-actuated controllable valves being utilized to increase or decrease hydraulic fluid pressure at the individual blades. Electrically-powered hydraulic pumps have also been disclosed for controlling blade actuation (U.S. Pat. No. 6,609,579). The steering tool housing 110 typically further includes electronic components for sensing and controlling the position of each of the blades. Steering tool embodiments typically further include one or more microcontrollers, electronic memory, and the like. Such electronics typically consume relatively little electrical power as compared to the solenoids and/or electrical pumps described above, although the invention is not limited in regard to electric power consuming components deployed in the tool housing 110.

It will be readily appreciated that steering tool functionality is advantageously enhanced by providing improved data transmission between housing 110 and rotating shaft 115. For example, closed-loop steering techniques, such as geo-steering techniques, commonly require communication with MWD and/or LWD sensors deployed elsewhere in the drill string. Typical geo-steering applications make use of directional formation evaluation measurements (azimuthally sensitive LWD measurements) made very low in the BHA, for example, in a rotating stabilizer located just above the drill bit and/or even in the drill bit. To enable true closed-loop control, such directional formation evaluation measurements are advantageously transmitted in substantially real time to electronic module 140. Electronic module 140 is also advantageously disposed in electronic communication with a downhole telemetry system (e.g., a mud pulse telemetry system) for transmitting various steering tool data up-hole. Such telemetry systems are typically deployed at the upper end of the BHA. In exemplary embodiments in accordance with the present invention a slip ring assembly is configured to transfer such electrical power and/or electronic data between the housing 110 and the shaft 115.

Figure 3A:
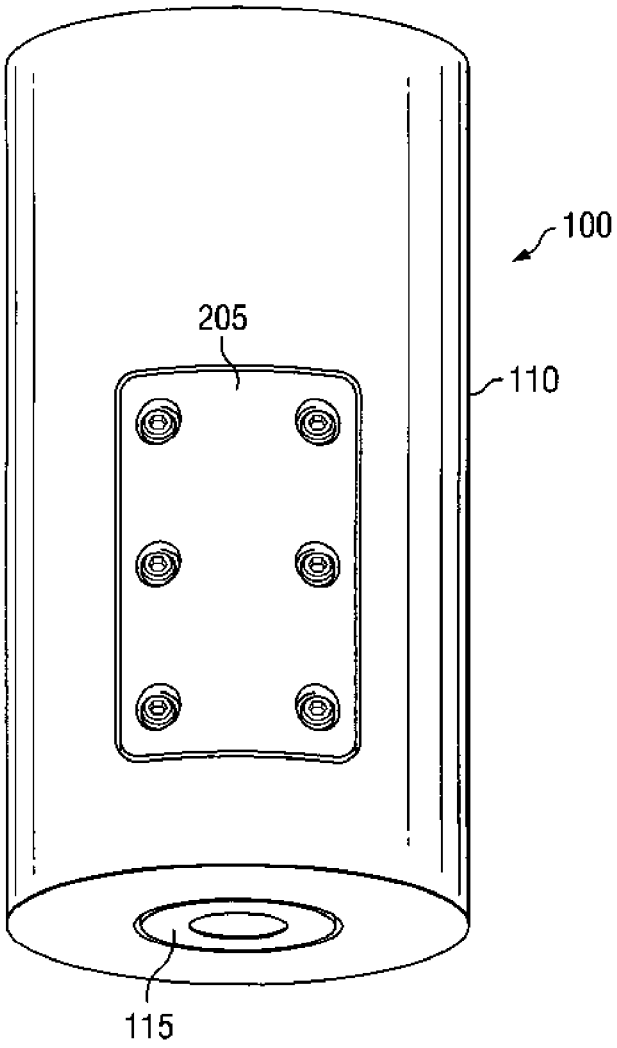
FIGS. 3A and 3B depict a portion of the steering tool shown on FIG. 2 with and without the hatch cover.
Figure 3B:
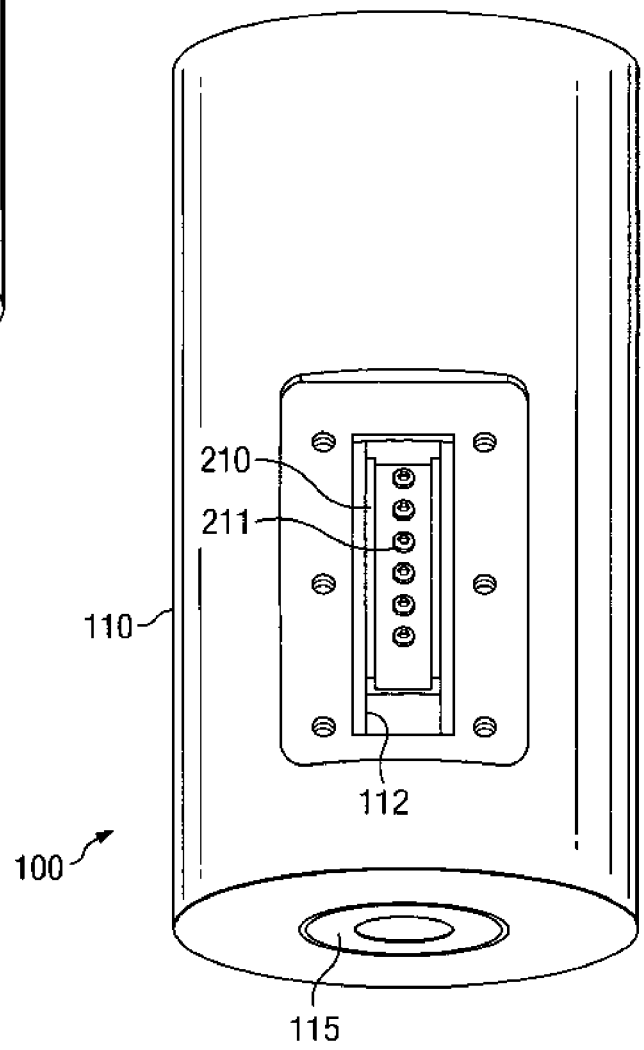

Turning now to FIGS. 3A and 3B, a portion of steering tool 100 is shown in more detail. As described in more detail below, the tool 100 includes an internal slip ring assembly 250 (FIGS. 4-9) configured in accordance with the present invention. FIG. 3A depicts a hatch cover 205 that is configured to sealingly engage an opening 112 in the housing 110 that provides access to the slip ring assembly 250. FIG. 3B depicts the steering tool 100 with the hatch cover 205 removed. A connector block 210 is deployed in the opening 112 in housing 110. The connector block 210 is fastened (e.g., via conventional screws 211) to an outer portion (a stator portion) of the slip ring assembly 250 and is also sized and shaped so as to physically engage opening 112 in housing 110. The connector block 210 therefore functions (in part) as an antirotation device in that it rotationally couples the stator portion of the slip ring assembly 250 to the housing 110.

Figure 4:
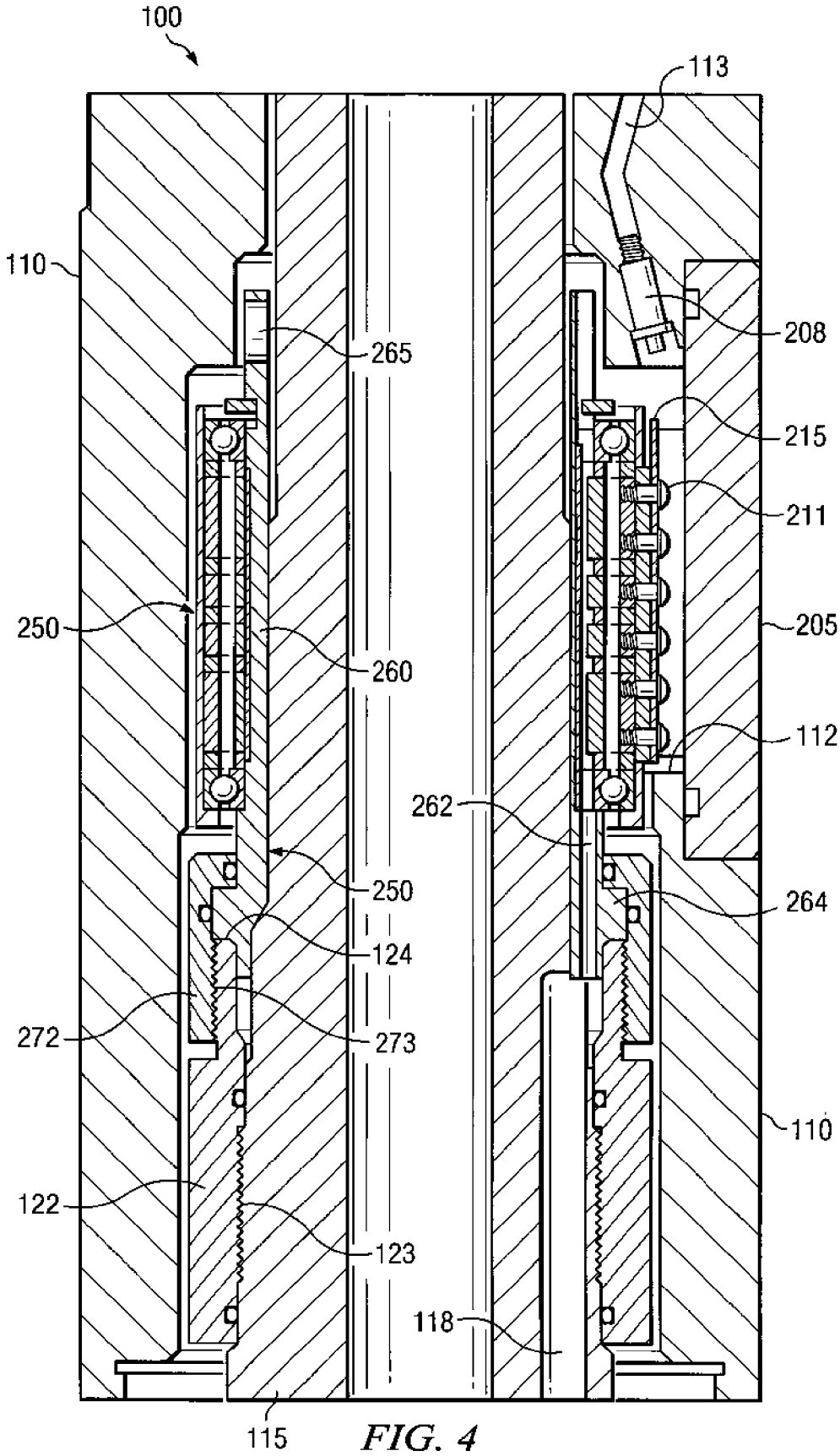
FIG. 4 depicts a longitudinal cross section of the steering embodiment shown on FIG. 3A.
Figure 5:
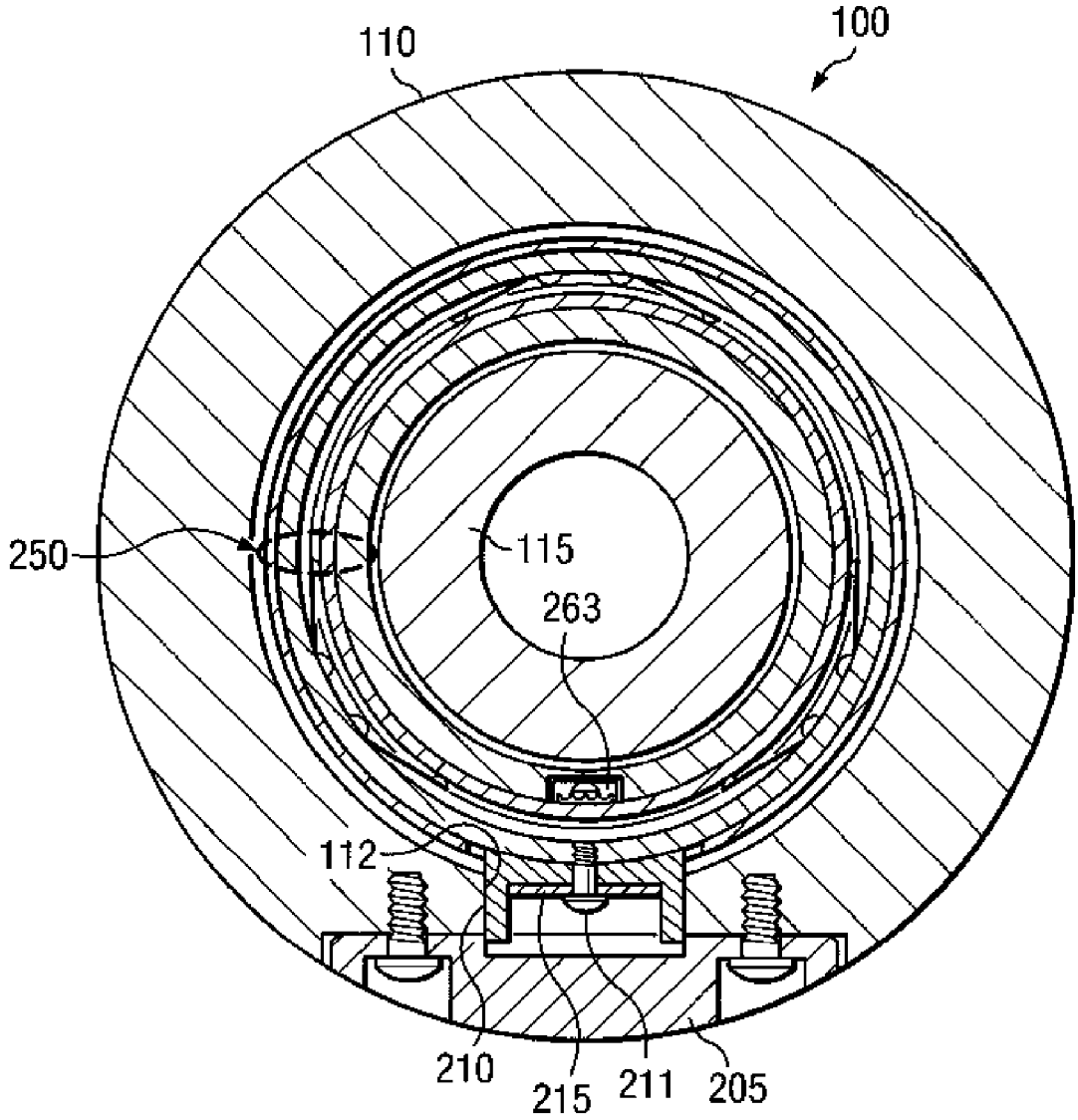
FIG. 5 depicts a circular cross section of the steering tool embodiment shown on FIG. 3A.

With reference now to FIGS. 4 and 5 steering tool 100 is depicted in longitudinal (FIG. 4) and circular cross section (FIG. 5). Connector block 210 extends radially outward from the slip ring assembly 250 into opening 112 thereby engaging housing 110 as described above. The slip ring assembly 250 is advantageously configured as a stand-alone assembly (as is described in more detail below with respect to FIG. 6). By stand-alone it is meant that slip ring assembly 250 may be essentially fully assembled prior to being incorporated into the steering tool 100. This feature of the invention advantageously simplifies fabrication of the slip ring assembly in that it is essentially fully assembled apart from the tool. The fully assembled slip ring may then be deployed on the shaft 115. Such a configuration advantageously tends to improve repeatability of the fabrication procedure and therefore the reliability of the fully assembled slip ring in service. Moreover, this feature of the invention also tends to improve the serviceability of the tool in that the slip ring assembly may be easily removed and replaced between drilling operations.

Slip ring assembly 250 is mounted on the shaft 115 and is configured to transmit electrical power and/or electronic data in either direction across the gap between the shaft 115 and housing 110. The exemplary embodiment depicted provides a plurality of physically distinct transmission channels between the shaft 115 and housing 110. As such, routing of the electrical signal and power transmission paths is now briefly described with respect to FIGS. 4 and 5 for the exemplary embodiments shown. A more detailed description of these same embodiments is included below with respect to FIGS. 6-8.

Figure 7:
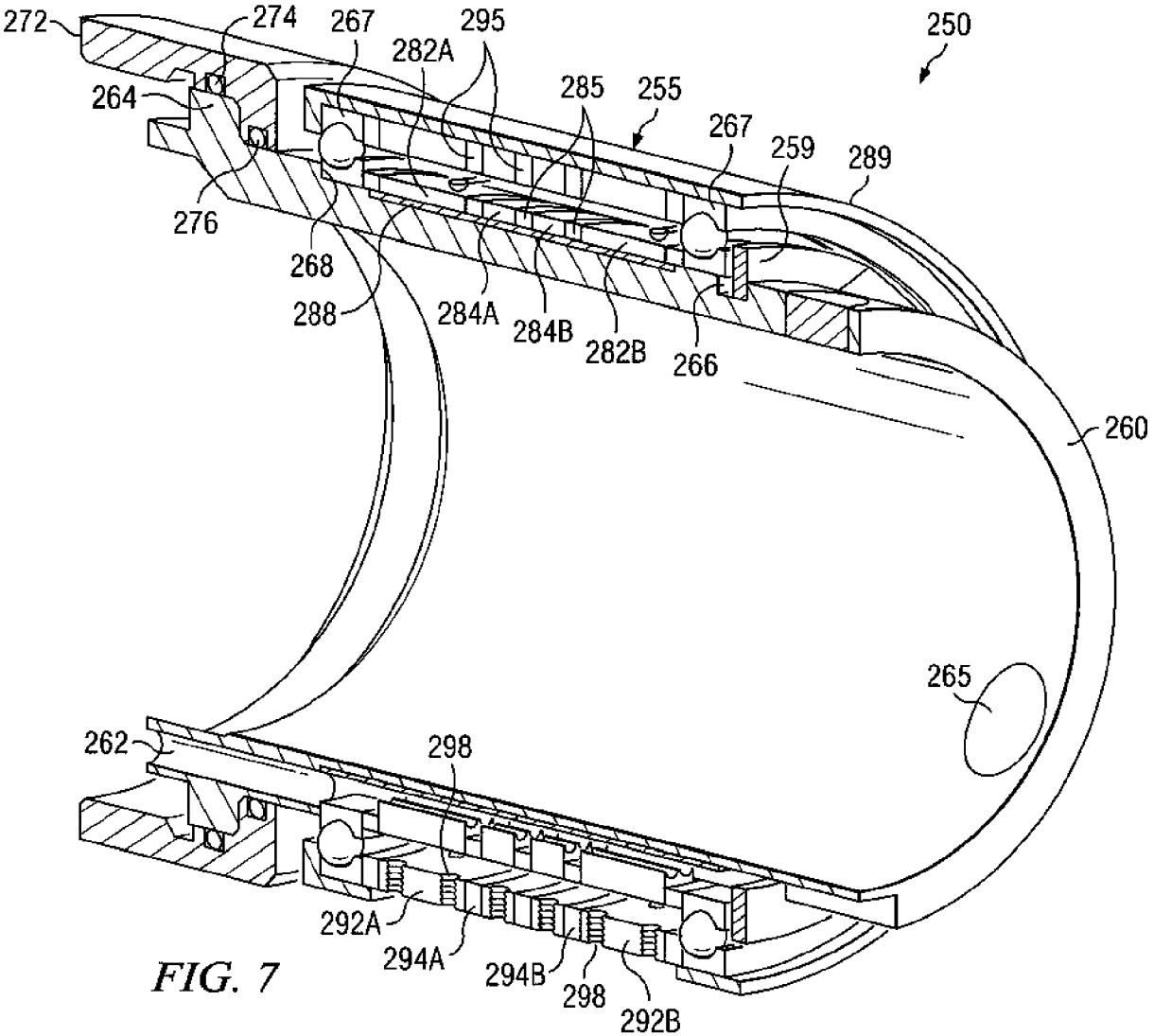
FIG. 7 depicts a longitudinal cross section of the slip ring assembly shown on FIG. 6.

In the exemplary embodiment depicted a plurality of electrical conductors (e.g., wires) may be routed through bore 118 in shaft 115 and bore 262 in slip ring carrier 260. These conductors provide an electrical and/or electronic connection with other BHA components, e.g., including an MWD tool, an LWD tool, and/or a battery sub. The conductors extend through axial slot 263 (FIG. 5) in slip ring carrier 260 where electrical connection is made with each of a plurality of electrically conductive rotor rings 282A, 282B, 284A, and 284B (FIG. 7). The rotor rings 282A, 282B, 284A, and 284B are electrically coupled with corresponding electrically conductive stator rings 292A, 292B, 294A, and 294B (FIG. 7) via a plurality of electrically conductive brushes 275 (FIG. 8) deployed in the annular gap between the rotor and stator rings. A plurality of metallic screws 211 fastens connector block 210 to the stator rings 292A, 292B, 294A, and 294B. These screws provide an electrically conductive path between the stator rings and circuit board 215 deployed in the connector block 210. Electrical connection is made between the circuit board 215 and bulkhead 208 which is sealingly deployed in bore 113 of housing 110 (the electrical connection between board 215 and bulkhead 208 is not shown on the FIGURES). The corresponding electrical conductors are routed through bore 113 to electronic control module 140 (FIG. 1).

Figure 6:
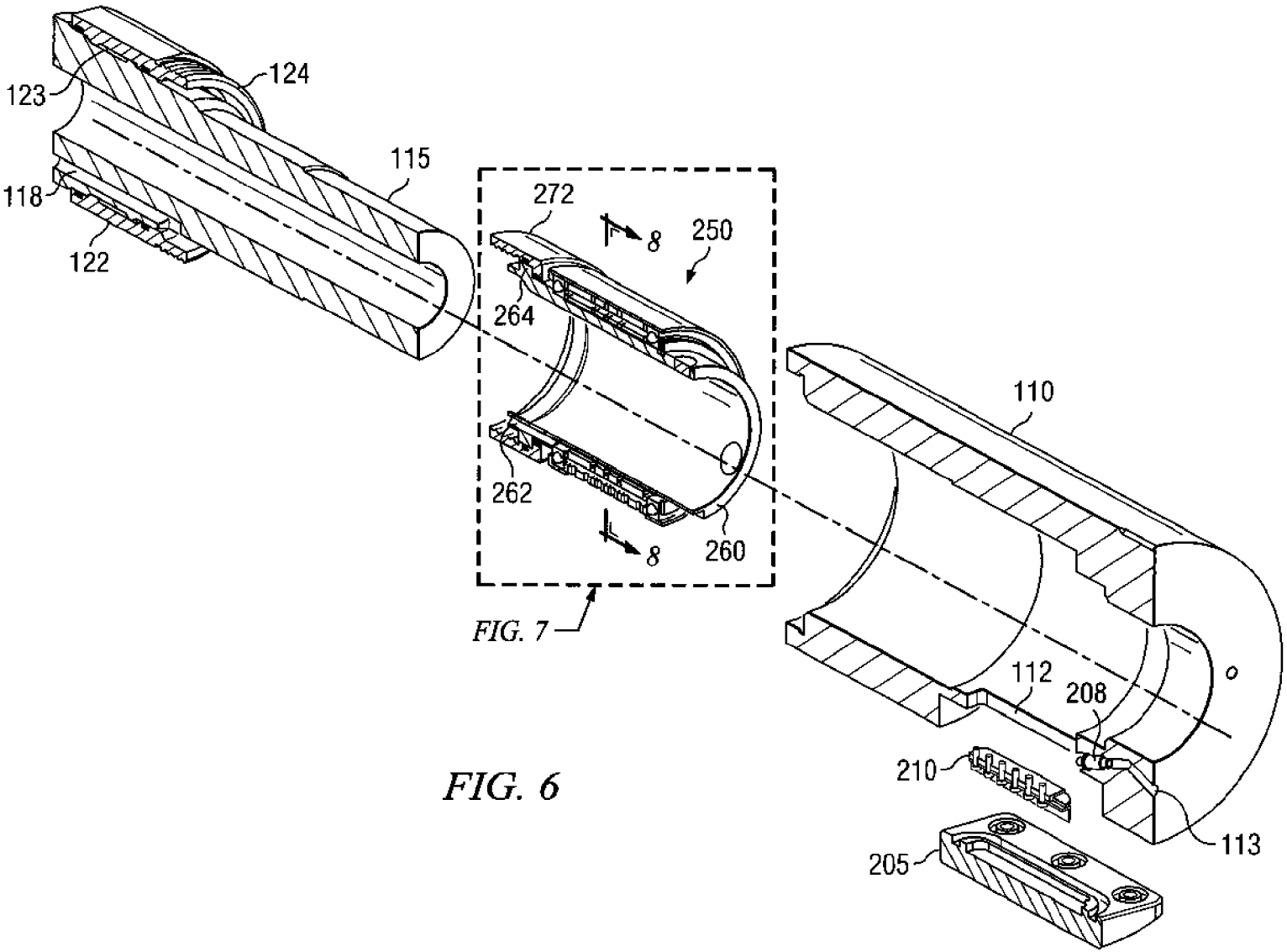
FIG. 6 depicts a partially exploded view of the steering tool embodiment depicted on FIG. 3A.

As stated above, slip ring assembly 250 may be advantageously configured as a stand-alone assembly. This feature of the invention is illustrated in FIG. 6, which depicts a partially exploded view of the exemplary embodiment shown on FIG. 3. Slip ring assembly 250 is shown fully assembled (as is described in more detail below with respect to FIGS. 7 and 8). The fully assembled slip ring assembly 250 may be slidably received on the shaft 115. A carrier sleeve 272, which is deployed about the slip ring carrier 260, may be threadably connected with shaft sleeve 122 as depicted at 273 (FIG. 4). Shaft sleeve 122 is in turn threadably connected with the shaft 115 as depicted at 123 such that the axial end 124 of shaft sleeve 122 abuts shoulder 264 of slip ring carrier 260. Threaded engagement of carrier sleeve 272 with shaft sleeve 122 rotationally fixes the slip ring assembly 250 to the shaft 115. Sleeve 272 further sealingly engages shoulder 264 of slip ring carrier 260, e.g., via one or more convention o-ring seals (as depicted at 274 and 276 on FIG. 7).

After deployment of the slip ring assembly 250 about shaft 115, the blade housing 110 may be deployed about the shaft 115 and the slip ring assembly 250. Connector block 210 may then be fastened to the stator rings 292A, 292B, 294A, and 294B as described above to establish an electrical connection between the shaft 115 and the housing 110. As also described above, deployment of connector block 210 in opening 112 serves to rotationally couple the stator rings 292A, 29213, 294A, and 294B with the housing 110. Hatch cover 205 may then be deployed in place over the connector block 210.

Figure 8:
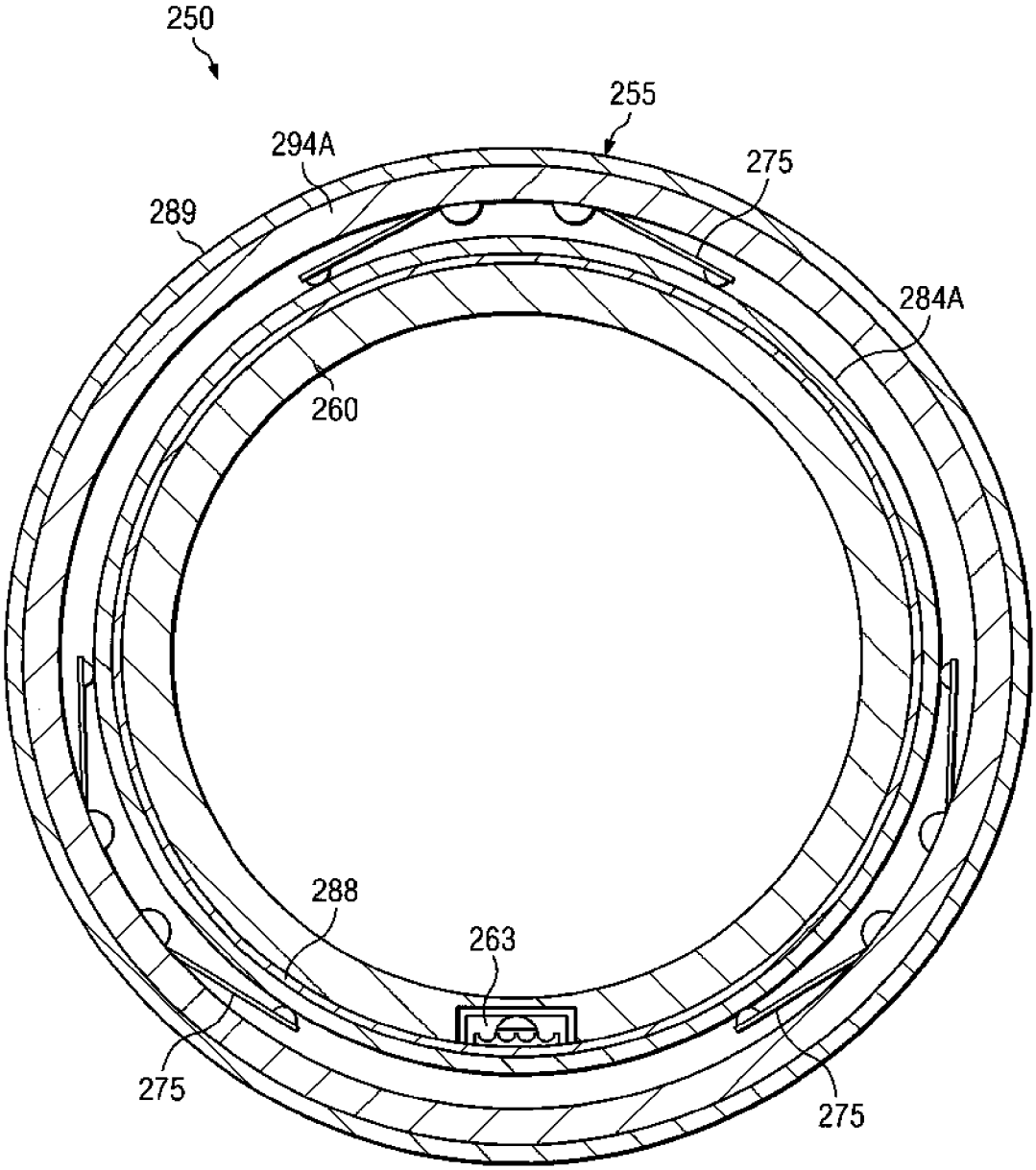
FIG. 8 depicts a circular cross section of the slip ring assembly shown on FIG. 6.

Turning now to FIGS. 7 and 8, the slip ring assembly 250 is described in more detail. In the exemplary embodiment depicted, a conductive ring assembly 255 is assembled about the slip ring carrier 260. An inner insulative sleeve 288 is deployed about the slip ring carrier 260. A plurality of axially spaced, concentric, rotor rings 282A, 282B, 284A, and 284B is deployed circumferentially about sleeve 288 and axially between first and second radial bearings 267. Insulative rings 285 are deployed axially between each of the rotor rings 282A, 282B, 284A, and 284B. Corresponding axially spaced stator rings 292A, 292B, 294A, and 294B are deployed about rotor rings 282A, 282B, 284A, and 284B with insulative rings 295 being deployed axially between each of the stator rings. An outer insulative sleeve 289 is deployed about the bearings 267, stator rings 292A, 292B, 294A, and 29413, and the insulative rings 295. A circular spring washer 259 (e.g., a Belleville spring) is deployed in slot 266 and urges the conductive ring assembly 255 into contact with shoulder 268.

In the exemplary embodiment depicted, each of the stator rings 292A, 292B, 294A, and 294B includes a plurality of electrically conductive brushes 275 (FIG. 8) physically and electrically connected to an inner surface of the ring (ring 294A as depicted). The brushes may alternatively be connected to an outer surface of the rotor rings 282A, 282B, 284A, and 284B. The invention is not limited in this regard. Nor is the invention limited to the use of any particular number of brushes 275. In general, increasing the number of brushes per ring tends to improve electrical contact, but also adds complexity to the assembly. The brushes 275 may be advantageously configured so as to be spring biased into electrical contact with an outer surface of the corresponding rotor rings 282A, 282B, 284A, and 284B. Such spring biasing preloads the brushes 275 into electrical contact with the rotor rings 282A, 282B, 284A, and 284B and therefore advantageously tends to counteract lifting forces caused by the use of viscous lubricating oils.

The exemplary embodiment depicted includes four stator rings 292A, 292B, 294A, and 294B and four corresponding rotor rings 282A, 282B, 284A, and 284B. While the invention is by no means limited in this regard, such a structure advantageously provides for simultaneous transmission of both electrical power and electronic data on physically distinct channels. For example, in the exemplary embodiment depicted, stator rings 292A and 292B (and corresponding rotor rings 282A and 282B) are configured for transmitting electrical power and therefore have a relatively large axial surface area and utilize six brushes 275 per ring pair. As will be appreciated by those of ordinary skill in the art, increasing the ring size and the number brushes deployed between the rings, increases the current transmission capability of the channel. Stator rings 294A and 294B (and corresponding rotor rings 284A and 284B) are configured for electronic data transmission and therefore have a relatively small axial surface area and utilize three brushes 275 per ring pair (since data signals are known to be low current). The invention is not limited in these regards and may utilize substantially any number of rotor and stator rings as well as substantially any number of brushes between the rings.

As further depicted on FIG. 7, each of the stator rings 292A, 292B, 294A, and 294B includes at least one threaded hole 298. In the exemplary embodiment depicted these holes 298 are sized and shaped so as to receive fastening screws 211 (FIGS. 4 and 5) used to both electrically and physically couple the connector block 210 to the stator rings.

While the invention is not limited in these regards, slip ring carrier 260 further includes a plurality of circumferentially spaced magnets 265 deployed therein. These magnets 265 may be used in combination with a conventional Hall-Effect sensor to measure the relative rotation rate of the shaft 115 with respect to the housing 110. The corresponding Hall-Effect sensor (not shown) is deployed in the housing 110. As is know to those of ordinary skill in the art, the Hall-Effect sensor is typically configured to send a pulse to a controller (in electronic module 140) each time one of the magnets 265 rotates by the sensor. In the exemplary embodiment shown, the controller receives three pulses (one for each magnet 265) per revolution of the shaft.

As stated above, the invention is not limited to rotary steerable or even steering tool embodiments. Exemplary embodiments in accordance with the invention may also be utilized, for example, in downhole motors (mud motors). Conventional mud motors typically include a bearing housing deployed below the power section, the bearing housing typically including a mandrel deployed to rotate in an outer housing.

Although the present invention and its advantages have been described in detail, it should be understood that various changes, substitutions and alternations can be made herein without departing from the spirit and scope of the invention as defined by the appended claims.

We claim:

1. A downhole tool comprising:

a shaft deployed in a housing and configured to rotate with respect to the housing, the housing including a removable hatch cover deployed over an opening in the housing;

a slip ring assembly deployed about the shaft and configured to provide electrical connection between the shaft and the housing, the slip ring assembly including (i) a plurality of axially spaced inner rotor rings deployed substantially concentrically with a corresponding plurality of axially spaced stator rings and (ii) a plurality of electrically conductive brushes deployed between the corresponding rotor and stator rings, the rotor rings being configured to rotate with the shaft;

a connector block fastened to the stator rings, the connector block extending radially outward from the stator rings and engaging the opening in the housing thereby rotationally coupling the stator rings to the housing.

2. The downhole tool of claim 1, wherein the connector block is fastened to the stator rings via a plurality of electrically conductive fasteners, the fasteners providing an electrical connection between the stator rings and electrical components deployed in the housing.

3. The downhole tool of claim 2, wherein the connector block comprises a circuit board deployed therein, the circuit board providing an electrical connection between the fasteners and the electrical components deployed in the housing.

4. The downhole tool of claim 1, wherein the rotor rings are deployed about a slip ring carrier, the slip ring carrier being deployed about and rotationally coupled with the shaft.

5. The downhole tool of claim 4, further comprising:

a first insulative sleeve deployed radially between the slip ring carrier and the rotor rings; and a second insulative sleeve deployed radially about the stator rings.

6. The downhole tool of claim 4, further comprising a carrier sleeve sealingly engaged with an outer shoulder portion of the slip ring carrier, the carrier sleeve threadably connected with a shaft sleeve deployed about the shaft.

7. The downhole tool of claim 1, wherein the slip ring assembly is configured to be fully assembled prior to deployment on the shaft.

8. The downhole tool of claim 1, wherein the slip ring assembly further comprises:

a substantially cylindrical slip ring carrier; and first and second radial bearings deployed about the slip ring carrier;

wherein the plurality of rotor rings and the corresponding plurality of stator rings are deployed axially between the bearings.

9. The downhole tool of claim 8, further comprising an electrically insulative ring deployed between each of the rotor rings and each of the stator rings.

10. The downhole tool of claim 1, wherein the brushes are physically and electrically connected to an inner surface of the stator rings, the brushes being further spring biased into electrical contact with an outer surface of the rotor rings.

11. The downhole tool of claim 1, wherein the downhole tool comprises a rotary steerable tool and the housing comprises a blade housing.

12. A rotary steerable tool comprising:

a shaft deployed concentrically in a blade housing and configured to rotate about a longitudinal axis with respect to the housing, the housing including a removable hatch cover deployed over an opening therein;

a slip ring assembly deployed about the shaft and configured to provide electrical connection between the shaft and the housing, the slip ring assembly including (i) a substantially cylindrical slip ring carrier, (ii) first and second radial bearings deployed about the slip ring carrier, (iii) a plurality of axially spaced inner rotor rings deployed substantially concentrically with a corresponding plurality of axially spaced stator rings, the rotor rings and the corresponding stator rings being deployed axially between the bearings, (iv) an electrically insulative ring deployed between each of the rotor rings and each of the stator rings, and (v) a plurality of electrically conductive brushes deployed between the corresponding rotor and stator rings, the rotor rings being configured to rotate with the shaft;

a connector block fastened to the stator rings, the connector block extending radially outward from the stator rings and engaging the opening in the housing thereby rotationally coupling the stator rings to the housing.

13. The rotary steerable tool of claim 12, wherein the connector block is fastened to the stator rings via a plurality of electrically conductive fasteners, the fasteners providing an electrical connection between the stator rings and electrical components deployed in the blade housing.

14. The rotary steerable tool of claim 13, wherein the connector block comprises a circuit board deployed therein, the circuit board providing an electrical connection between the fasteners and the electrical components deployed in the housing.

15. The rotary steerable tool of claim 12, further comprising:

a first insulative sleeve deployed between the slip ring carrier and the rotor rings; and a second insulative sleeve deployed about the stator rings.

16. The rotary steerable tool of claim 12, further comprising a carrier sleeve sealingly engaged with an outer shoulder portion of the slip ring carrier, the carrier sleeve threadably connected with a shaft sleeve deployed about the shaft.

17. The rotary steerable tool of claim 12, wherein the slip ring assembly is configured to be fully assembled prior to deployment on the shaft.

18. The rotary steerable tool of claim 12, wherein the brushes are physically and electrically connected with an inner surface of the stator rings, the brushes being further spring biased into electrical contact with an outer surface of the rotor rings.

19. A method for establishing an electrical connection between first and second electrical devices in a downhole tool, the first device being rotationally coupled with a shaft, the second device being rotationally coupled with a housing, the shaft configured to rotate in the housing; the method comprising;

(a) assembling a slip ring assembly, the slip ring assembly including (i) a substantially cylindrical slip ring carrier, (ii) first and second radial bearings deployed about the slip ring carrier, (iii) a plurality of axially spaced inner rotor rings deployed substantially concentrically with a corresponding plurality of axially spaced stator ring, the rotor ring and the corresponding stator rings being deployed axially between the bearings, (iv) an electrically insulative ring deployed between each of the rotor rings and each of the stator rings, and (v) a plurality of electrically conductive brushes deployed between the corresponding rotor and stator rings;

(b) deploying the assembled slip ring assembly about the shaft, said deployment rotationally coupling the slip ring carrier to the shaft;

(c) electrically connecting the first device with the rotor rings;

(d) deploying the housing about the shaft and the slip ring assembly;

(e) fastening a connector block to the stator rings, the connector block physically engaging an opening in the housing such that the stator rings are rotationally coupled with the housing;

(f) electrically connecting the second device with the connector block; and (g) deploying a hatch cover over the opening.

20. The method of claim 19, wherein the connector block comprises a circuit board deployed therein and the second device is electrically connected with the circuit board in (f).

21. The method of claim 19, wherein (b) further comprises threadably connecting a carrier sleeve with a shaft sleeve, the carrier sleeve being sealingly engaged with an outer shoulder portion of the slip ring carrier and the shaft sleeve being threadably connected with the shaft.

* * * * *